US011325012B2

(12) United States Patent
Beyltiens

(10) Patent No.: US 11,325,012 B2
(45) Date of Patent: May 10, 2022

(54) MONOFILAMENT STRING FOR USE IN STRING RACKET SPORTS

(71) Applicant: Luxilon Industries NV, Wijnegem (BE)

(72) Inventor: Thierry Beyltiens, Hombeek (BE)

(73) Assignee: LUXILON INDUSTRIES NV, Wijnegem (BE)

( * ) Notice: Subject to any disclaimer, the term of this patent is extended or adjusted under 35 U.S.C. 154(b) by 273 days.

(21) Appl. No.: 16/515,802

(22) Filed: Jul. 18, 2019

(65) Prior Publication Data

US 2020/0023241 A1 Jan. 23, 2020

(30) Foreign Application Priority Data

Jul. 19, 2018 (EP) ..... 18184387

(51) Int. Cl.

| | |
|---|---|
| ***A63B 51/02*** | (2015.01) |
| ***D01D 5/36*** | (2006.01) |
| ***D01F 8/06*** | (2006.01) |
| ***D01F 8/12*** | (2006.01) |
| ***D01F 8/14*** | (2006.01) |

(52) U.S. Cl.

CPC ..... *A63B 51/02* (2013.01); *D01D 5/36* (2013.01); *D01F 8/06* (2013.01); *D01F 8/12* (2013.01); *D01F 8/14* (2013.01); *A63B 51/023* (2020.08)

(58) Field of Classification Search

CPC ..... A63B 51/02; A63B 51/023; D01F 8/06; D01F 8/12; D01F 8/14; D01D 5/36

See application file for complete search history.

(56) References Cited

U.S. PATENT DOCUMENTS

| | | | | |
|---|---|---|---|---|
| 4,055,941 | A * | 11/1977 | Rivers, Jr | A63B 51/02 57/248 |
| 4,565,061 | A * | 1/1986 | Durbin | A63B 51/02 57/225 |
| 4,586,708 | A * | 5/1986 | Smith | A63B 51/02 473/537 |
| 4,909,510 | A * | 3/1990 | Sahatjian | A63B 51/02 473/537 |
| 2010/0040878 | A1* | 2/2010 | Van Malderen | D01F 8/04 428/373 |

FOREIGN PATENT DOCUMENTS

| | | | |
|---|---|---|---|
| EP | 1964949 | A1 | 9/2008 |
| EP | 2175055 | A2 | 4/2010 |
| JP | 2011056132 | A | 3/2011 |

OTHER PUBLICATIONS

European Search Report from EP Application No. 18184387, dated Dec. 20, 2018.

* cited by examiner

*Primary Examiner* — Raleigh W Chiu
(74) *Attorney, Agent, or Firm* — Workman Nydegger

(57) ABSTRACT

A monofilament string for use in string racket sports, wherein the monofilament string comprises: a covering material; a core material embedded in the covering material, wherein the core material comprises: a sea region comprising a thermoplastic elastomer; and a plurality of island regions comprising a thermoplastic plastic doped with one or more doping agents, wherein the plurality of island regions is embedded in the sea region; and wherein a geometry and/or a distribution of the island regions in the sea region is such that a tangent modulus of a stress-strain curve of the monofilament string increases with increasing strain in a playing stress range.

13 Claims, 3 Drawing Sheets

MONOFILAMENT STRING FOR USE IN STRING RACKET SPORTS

FIELD OF THE INVENTION

The present invention generally relates to strings that can be used for stringing rackets for ball sports, such as for example tennis, squash, racket ball, badminton, etc.

BACKGROUND OF THE INVENTION

Strings for tennis, squash, badminton rackets are required to have specific characteristics of resistance to pulling and to elongation under a brief constraint or under repeated constraints. Under repeated constraints, strings should rapidly and totally take up their initial length again. Strings should also have good properties in terms of elasticity modulus, breakage and tensile strength, tension relaxation, loop strength, and good properties of resistance to different conditions of use, notably abrasion resistance, resistance to creasing or kinking, resistance to various atmospheric factors such as high humidity and temperature as well as to the various constraints to which they are subjected during for example their fitting to rackets.

The playing characteristics of strings are often indicated in professional terms with power and control, ball sensitivity and touch, comfort, spin, performance, elasticity, ball speed, etc. It is important how these playing characteristics materialise under different playing conditions such as for example how the ball control behaves both when playing soft and when playing hard.

Strings for tennis rackets are nowadays mostly based on a polymer basis and are designed as a monofilament or as multifilament. Monofilament strings mostly consist of a single thread of polyester provided with a thin outer protection and finishing layer. A diameter of a monofilament tennis string is usually comprised between 1.1 to 1.35 mm.

Even though these strings demonstrate a higher durability, they can be experienced as stiff, especially by a player who just starts learning tennis. It is generally accepted that monofilament strings allow for a better control of the ball when playing hard but getting familiar with better controlling the ball when playing hard remains a challenge for most players who just start practicing tennis. Monofilament strings also have the tendency to quickly lose their tension, as a result of which the control diminishes, and the string starts feeling 'loose'. This further increases the difficulty for a beginner to improve his play.

EP2175055A2 describes a monofilament string for use in tennis rackets which comprises a so-called 'islands in the sea' concept. This concept consists of using various polymers or polymer mixtures separately in the same monofilament string, and arrange them in such a geometrical manner versus one another that, if one looks at a cross-section of the manufactured string, this appears to be a manifold of separate cores or 'little islands', shaped by a certain polymer or a group of polymers, surrounded and kept in place by a matrix or 'sea', mainly but not necessarily exclusively consisting of another polymer or a group of other polymers.

The monofilament strings described in EP2175055A2 still have a stiffness that is too high which allows for too little control over the ball for a player who just starts practicing tennis when playing soft or when playing hard. This too high stiffness when playing soft or hard can be held responsible for a clearly different ball feeling than expected, which can be confusing and frustrating for a beginner.

It is an objective of the present invention to disclose a device that overcomes the above identified shortcomings of existing solutions. More particularly, it is an objective to disclose a monofilament string which demonstrates excellent structural properties, and which further provides a player starting learning playing a ball sport with a racket with a better experience when playing soft and when playing hard.

SUMMARY OF THE INVENTION

According to a first aspect of the present invention, the above defined objectives are realized by a monofilament string for use in string racket sports, wherein the monofilament string comprises:

a covering material;

a core material embedded in the covering material, wherein the core material comprises:

- a sea region comprising a thermoplastic elastomer; and
- a plurality of island regions comprising a thermoplastic plastic doped with one or more doping agents, wherein the plurality of island regions is embedded in the sea region;

and wherein a geometry and/or a distribution of the island regions in the sea region is such that a tangent modulus of a stress-strain curve of the monofilament string increases with increasing strain in a playing stress range.

The monofilament string according to the present invention comprises a so-called 'islands in the sea' concept and further demonstrates a tangent modulus of a stress-strain curve which increases with increasing strain in a playing stress range. In other words, the monofilament string according to the present invention demonstrates a larger elasticity than a standard monofilament string and a larger elasticity than a standard monofilament string with 'islands in the sea' in a playing stress range. The stress-strain curve of the monofilament string according to the present invention demonstrates a positive curvature in the playing stress range, while the stress-strain curves of a standard monofilament and a standard monofilament with 'islands in the sea' both demonstrate a negative curvature or a constant tangent modulus in the same playing stress range. In other words, the geometry and/or a distribution of the island regions in the sea region of the monofilament string according to the present invention is such that a stress-strain curve of the monofilament string according to the present invention comprises a positive curvature, i.e. a positive derivative of the derivative of the stress-strain curve, in a playing stress range. In other words, at constant stress in the playing stress range, the strain of the monofilament string according to the present invention is larger than the strain of a standard monofilament string and is larger than the strain of a standard monofilament string with 'islands in the sea'. This way, the elongation of the monofilament string achievable in the playing stress range is much larger than the elongation achievable in the same playing stress range with a monofilament string or with a monofilament string comprising 'islands in the sea'.

While maintaining a high durability and without losing tension, it becomes possible with the monofilament string according to the present invention to realise a better ball feeling. A suppler feeling is achieved during playing with the monofilament string according to the present invention in a playing stress range which relates to a so-called soft play and to a so-called hard play, which results in better comfort for the player and better ball feeling, especially for players which start practising a string racket sport such as for example tennis, squash, racket ball, badminton, etc. Thanks to this increased elasticity in the playing stress range, the monofilament string according to the present invention provides improved playing characteristics, especially enables a player starting the string racket sport to develop a 'feeling' for the ball faster and allows him to rapidly improve his experience and quality of play. In other words, a player who starts learning how to play a string racket sport such as for example tennis, squash, racket ball, badminton, etc. will enjoy better control over the ball than with a standard monofilament string or than with a standard monofilament string with 'islands in the sea'.

According to an optional aspect of the invention, the distribution of the island regions is such that the island regions are arranged in a geometrical pattern relative to each other and/or to a longitudinal axis of the monofilament string.

This way, the monofilament string is provided with specific playing characteristics, such as for example strength, stiffness and playing characteristics, by making adequate choice of the materials for the covering material and for the core material, especially for the island regions, and by making adequate choice for the specific geometry given to the island regions. For example, the island regions can be periodically distributed in the core material of the monofilament string. For example, the island regions all have similar cross-section surfaces on a cross-section along the longitudinal axis of the monofilament string. Alternatively, the island regions are of different sizes and have different cross-section surfaces on a cross-section along the longitudinal axis of the monofilament string. Alternatively, the island regions are randomly distributed in the core material of the monofilament string.

According to an optional aspect of the invention, the geometry of the island regions is such that each of the island regions comprises a cross-section with a substantially circular shape and with one surface side leaning close against a surface of the covering material of the monofilament string such the surface side displays a curvature which lines the curvature of the surface of the covering material of the monofilament string.

This way, the monofilament string locally obtains a large surface of island region and therefore a large surface of thermoplastic plastic of the island regions close to the outside of the monofilament string. Since the island regions will be at most against the outside of the monofilament string, and since the monofilament string is condensed by compression, in case of compression of the monofilament string, excellent characteristics are obtained with the monofilament string with for example improved cushioning from the thermoplastic plastic of the island regions which in turns results in a better shock absorption. For example, the island regions are distributed along an inside diameter of the monofilament string close to the outer surface of the covering material. Alternatively, the island regions have a cross-section that has a multi-angular shape.

According to an optional aspect of the invention, the geometry and the distribution of the island regions are such that each of the island regions comprises a cross-section with a substantially circular shape and with at least one contact side leaning close against at least one contact side of another island region.

This way, an inside diameter of a cross-section of the monofilament string along the longitudinal axis of the monofilament string is largely dominated by the island regions which are closely adjacent to each other in the monofilament string. In other words, the sea region of the core material between two adjacent island regions is minimized such that the effect of the thermoplastic elastomer of the sea region between two adjacent island regions on the characteristics of the monofilament string is minimized.

According to an optional aspect of the invention, the monofilament string comprises three island regions.

A monofilament string comprising three island regions is a most preferred embodiment. Indeed, with three island regions, a core of the sea region of the core material is minimized such that the effect of the thermoplastic elastomer of the sea region on the characteristics of the monofilament string is minimized. For example, the island regions have a substantially circular diameter of about 0.6 mm on a cross-section of a monofilament string of 1.25 mm diameter. Alternatively, the monofilament string comprises two, four, five, six, seven, eight, nine, ten, tens, etc. island regions which have a geometry, and which are distributed in the sea region of the core material such that a core of the sea region of the core material is minimized such that the effect of the thermoplastic elastomer of the sea region on the characteristics of the monofilament string is minimized.

According to an optional aspect of the invention, each of the island regions comprises one surface side leaning close against a surface of the covering material of the monofilament string such the surface side displays a curvature which lines the curvature of the surface of the covering material of the monofilament string; and wherein each of the island regions further comprises two contact sides, wherein each contact side of an island region leans close against a contact side of another island region.

This way, a cross-section of the monofilament string along the longitudinal axis of the monofilament string is largely dominated by the island regions. Each island regions in indeed closely in contact with the outer surface of the cover material and at the same time closely in contact with two adjacent island regions. This way, a core of the monofilament string, as part of the sea of the monofilament string and comprising the thermoplastic elastomer and defined as a substantially circular region at the centre of the monofilament string along the longitudinal axis, is minimized. The characteristics of the monofilament string are therefore resulting mainly from the characteristics provided by the island regions, i.e. by the thermoplastic plastic doped with one or more doping agents, and dominated by the characteristics provided by the island regions and particularly their material. In other words, the geometry and the distribution of the island regions increase the elasticity of the monofilament string by ensuring the surface of the sea region of the core material of the monofilament string on a cross-section of the monofilament string along the longitudinal axis is minimized. Preferably, all three island regions comprise a cross-section with the same substantially circular shape. Preferably, all three island regions comprise a cross-section with a circular shape. Alternatively, one or more of the three island regions comprises a cross-section with an oval shape.

In case of compression of the monofilament string, because of the distribution of the island regions in the monofilament string, and more particularly in the case of a symmetric distribution of the island regions in the monofilament string, the island regions dynamically collaborate by pushing back the underlying island region, thereby further taking advantage of the elasticity of the underlying island region.

According to an optional aspect of the invention, the playing stress range corresponds to a total force applied to the monofilament string comprised between 150 Newton and 400 Newton.

A total force comprises the force applied by a ball on the monofilament string, for example a tennis ball or squash ball or a shuttlecock, and further comprises the force created by the tension of the string racket when the monofilament string is strung on the string racket.

According to an optional aspect of the invention, the tangent modulus of the stress-strain curve is comprised between 2000 MPa and 5000 MPa.

The tangent modulus of the stress-strain curve in the playing stress range according to the present invention corresponds to the derivative of the stress-strain curve of the monofilament string in the playing stress range.

According to an optional aspect of the invention, a soft feeling is produced when hitting a tennis ball with the monofilament string with a total force comprised between 210 Newton and 250 Newton, and a hard feeling is produced when hitting a tennis ball with the monofilament string with a total force comprised between 270 Newton and 320 Newton.

The tangent modulus of the stress-strain curve of the monofilament string increases for increasing strain in a playing stress range. In other words, for a low load hit, for example with a total force comprised between 210 Newton and 250 Newton, the monofilament string demonstrates a larger strain and therefore a larger elasticity than for a high load hit, for example with a total force comprised between 270 Newton and 320 Newton. This way, when playing, a player has a nicer playing feeling as the effect of the monofilament string on the tennis ball corresponds to his intended play: when the player wants to play soft with a low load hit, the monofilament string demonstrates a larger strain and therefore a softer play than when the player wants to play soft with a high load hit, for which the monofilament string demonstrates a smaller strain and therefore a stiffer play.

Preferably, the monofilament string comprises mainly a polymer or several polymers or polymer mixtures selected from one or several of the following groups of polymers or polymer families: PET, co-PET, PLA, PBT, PPT, PA and/or copolymers of these materials, PEEK, PPS, polyether-polyester block polymer, polyether-polyamide block polymer, TPU, PVDF and/or other fluorinated polymers.

Alternatively, the monofilament string comprises at least a polyester made from a dicarboxylic acid from the group of phthalic acid, isophthalic acid, adipic acid, sebacic acid, 2.6 naphthalene dicarboxylic acid and a diol chosen from the group of a polyalkylene glycol, diethylene glycol, propylene glycol, tetramethyleneglycol, 1,4 cyclohexane diol, or copolymers of these polyesters or blends of two or more of such polyesters or copolymers thereof.

Alternatively, the monofilament string comprises at least a polymer or polymer mixture selected from the group of thermoplastic elastomers, especially polyolefins, especially thermoplastic olefins (TPO); polyethylene and thermoplastic polyethylene; polypropene; ethylenepropene copolymers, especially EPDM, polyisoprene and copolymers thereof, polybutadiene and copolymers thereof, polyisobutylene and copolymers thereof; polyesters for example polyethylene terephthalate (PET) and PLA, or copolymers thereof; thermoplastic polyurethane (TPU) and copolymers thereof, styrenebutadiene styrene copolymers and block copolymers, polyethers, polyesters, polyether esters, polyphenylene oxide, polyether etherketone (PEEK), PEEKK (polyether etherketoneketone), ABS, polymethyl acrylate and polymethyl methacrylate, ethylenetetrafluorethylene, ethylenechlorotetrafluorethylene, polyvinylidene fluoride (PVDF), on teflon based polymers such as FEE, MFA and PFA and mixtures of two or more of these polymers or mixtures that comprises one or more of the aforementioned polymers.

Alternatively, the monofilament string comprises at least one plastic that consists of a thermoplastic material in which at least one alkylbenzyl ester of a 1,2 dicarboxylic acid, or one of its derivates, is homogeneously distributed and whereby the alkyl chain of the alkylbenzyl ester, or one of its derivates comprises at least five carbon atoms. This alkylbenzyl ester can furthermore comprise a diester of phthalic acid or phthalic acid anhydride, with a benzyl group on one hand, and an alkyl group with five to twelve carbon atoms on the other hand, especially with seven to nine carbon atoms, especially with an isononyl group or with a group comprising a mixture of the corresponding isomers.

According to an optional aspect of the invention, the thermoplastic elastomer of the sea region comprises at least one polymer from the group of the polymer phthalates.

The sea region for example comprises at least one polymer from the group of the polymeric phthalates, for example polyethyleneterephthalate and/or a copolymer and/or a block copolymer and/or a mixture of two or more of these polymers and/or a mixture that contains one or more of the aforementioned polymers. Alternatively, the sea region for example also comprises amongst others a mixture of polyvinylidenefluoride and polyethylene terephthalate or one or several derivates thereof. Preferably, the composing polymers or polymer mixtures can be selected from the group of polyamides, especially nylon 6, nylon 66, nylon 11, nylon 12, or nylon 46 or copolymers thereof; or from the group of the polyesters, especially polyethyleneterephthalate (PET) and PLA polyether ketones, especially polyether etherketone (PEEK), PEEKK, poly-oxymethylene (POM), polyvinylidene fluoride (PVDF), copolymers of polyesters or mixtures of two or more of these polymers.

According to an optional aspect of the invention, the thermoplastic plastic of the island regions comprises one polymer from the group of thermoplastic polyesters and/or a copolymer and/or a block copolymer and/or a mixture of two or more of these polymers.

This way, the island regions for example comprise polyethylene terephthalate. Alternatively, the island regions comprise at least one plastic from the group of the thermoplastic polyurethanes and/or a copolymer and/or block copolymer and/or a mixture of two or more of these polymers and/or a mixture that comprises one or more of the aforementioned polymers and that the shore hardness is between A40 and D85, even better between shore A70 to D70. The island regions for example mainly comprise at least one polymer selected from the group of the fluorinated polymers, especially polyvinylidene fluoride and/or a copolymer and/or a block copolymer and/or a mixture of two or more of these polymers and/or a mixture that contains one or more of the aforementioned polymers.

According to an optional aspect of the invention, the one or more doping agents further comprise a thermoplastic elastomer dispersed in said thermoplastic plastic.

For example, the island regions and/or the sea region comprise functional additives, for example nanoparticles created by one of the composing plastics and/or for example fillers such as titanium dioxide, silica, aluminium oxide, calcium carbonate, clay, derivates, siliconnitride, zirconiumoxide and/or active stabilisers such as anti-oxidants, UV absorbers, etc. The presence of aforementioned nanoparticles in the material of the sea region namely influences the surface of the string and influences the playing behaviour of the string in that way. The presence of aforementioned nanoparticles in the material of the island regions offers the advantage that savings can be made on more expensive fillers and additives, especially when using nanoparticles of the recycled main materials.

According to an optional aspect of the invention, the one or more doping agents comprise a siloxane polymer dispersed in the thermoplastic plastic.

This way, the stability of the monofilament string is greatly improved. Tangent modulus larger than 3500 MPa can be measured for the monofilament string comprising island regions doped with a siloxane polymer. A suitable siloxane polymer is for example the "Dow Corning® MB50-010 Masterbatch" commercialized by Dow Corning. This siloxane polymer comprises an ultra-high molecular weight siloxane polymer dispersed in thermoplastic polyester elastomer. For example, the siloxane polymer is a pelletized formulation containing 50% of an ultra-high molecular weight siloxane polymer dispersed in HYTREL.

According to an optional aspect of the invention, in the playing stress range and at constant stress, a monofilament string wherein one or more doping agents comprise a siloxane polymer demonstrates a strain 4 to 15% larger than a strain demonstrated by a monofilament string wherein one or more doping agents comprise a thermoplastic elastomer.

In other words, in the playing stress range and at a given strain, a tangent modulus of the stress-strain curve of a monofilament string wherein one or more doping agents comprise a thermoplastic elastomer at an elastomer stress corresponds to a tangent modulus of the stress-strain curve of a monofilament string wherein one or more doping agents comprise a siloxane polymer is 4 to 15% at a siloxane stress, and the siloxane stress is larger than the elastomer stress.

According to an optional aspect of the invention, a breaking stress of a monofilament string wherein one or more doping agents comprise a siloxane polymer is 10 to 15% larger than a breaking stress of a monofilament string wherein one or more doping agents comprise a thermoplastic elastomer.

In other words, the monofilament string demonstrates a larger elasticity than a standard monofilament string and a larger elasticity than a standard monofilament string with 'islands in the sea' in a playing stress range for which a total force applied is comprised between 150 Newton and 400 Newton. The monofilament string also demonstrates a larger elasticity than a standard monofilament string and a smaller elasticity than a standard monofilament string with 'islands in the sea' in a playing stress range for which a total force applied is larger than 400 Newton. This way, the monofilament string demonstrates a lower elasticity than a standard monofilament with 'islands in the sea' in this range, and the monofilament string provides a stiffer feeling to a player in this range. The stability of the monofilament string is therefore greatly improved with the doping of one or more island regions with a siloxane polymer.

For example, tests were performed to compare a monofilament string according to the present invention wherein three island regions each comprise one or more doping agents which comprise a thermoplastic elastomer to a monofilament string according to the present invention wherein three island regions each comprise one or more doping agents which comprise a siloxane polymer. The tangent modulus of a stress-strain curve of each monofilament string and the breaking stress of each monofilament string have been measured for different total forces applied onto the monofilament strings respectively. The results are summed up in table I below:

| | Tangent modulus (MPa) | Relative difference for the tangent modulus | Breaking stress (N) | Relative difference for the breaking stress |
|---|---|---|---|---|
| Monofilament string comprising doping agents comprising thermoplastic elastomer | | | | |
| Total force comprised between 210 and 250 Newton | 2584.2 | | 502.6 | |
| Total force comprised between 270 and 320 Newton | 3346.0 | | 505.8 | |
| Monofilament string comprising doping agents comprising siloxanepolymer | | | | |
| Total force comprised between 210 and 250 Newton | 2706.9 | +4.7% | 566.3 | +12.7% |
| Total force comprised between 270 and 320 Newton | 3709.6 | +10.9% | 569.3 | +12.6% |

According to a second aspect of the invention, there is provided a method for manufacturing a monofilament string for use in string racket sports, the method comprising the steps of:

providing a covering material;

providing a core material;

embedding the core material in the covering material by forming a sea region comprising a thermoplastic elastomer and by embedding a plurality of island regions comprising a thermoplastic plastic doped with one or more doping agents in the sea region, thereby forming a monofilament string matrix, and wherein a geometry and/or a distribution of the island regions in the sea region is such that a tangent modulus of a stress-strain curve of the monofilament string increases with increasing strain in a playing stress range;

extruding the monofilament string matrix;

cooling the monofilament string matrix;

subjecting the monofilament string matrix to a process cycle comprising:

stretching the monofilament string matrix, thereby resulting in a stretched monofilament string matrix;

annealing the stretched monofilament string matrix; thereby forming the monofilament string.

The method according to the present invention comprises forming a so-called 'islands in the sea' concept such that the resulting manufactured monofilament strings demonstrate a tangent modulus of a stress-strain curve which increases with increasing strain in a playing stress range. In other words, the monofilament strings produced with the method according to the present invention demonstrate a larger elasticity than a standard monofilament string and a larger elasticity than a standard monofilament string with 'islands in the sea' in a playing stress range. The stress-strain curve of the monofilament string formed with the method according to the present invention demonstrates a positive curvature in the playing stress range, while the stress-strain curves of a standard monofilament and a standard monofilament with 'islands in the sea' both demonstrate a negative curvature or a constant tangent modulus in the same playing stress range. In other words, the geometry and/or a distribution of the island regions in the sea region of the monofilament string produced with the method according to the present invention is such that a stress-strain curve of the monofilament string produced with the method according to the present invention comprises a positive curvature, i.e. a positive derivative of the derivative of the stress-strain curve, in a playing stress range. In other words, at constant stress in the playing stress range, the strain of the monofilament string manufactured with the method according to the present invention is larger than the strain of a standard monofilament string and is larger than the strain of a standard monofilament string with 'islands in the sea'. This way, the elongation of the monofilament string achievable in the playing stress range with the method according to the present invention is much larger than the elongation achievable in the same playing stress range with a monofilament string or with a monofilament string comprising 'islands in the sea'.

While maintaining a high durability and without losing tension, it becomes possible with the monofilament string produced by the method according to the present invention to realise a better ball feeling. A suppler feeling is achieved during playing with the monofilament string formed with the method according to the present invention in a playing stress range which relates to a so-called soft play and to a so-called hard play, which results in better comfort for the player and better ball feeling, especially for players which start practising tennis. Thanks to this increased elasticity in the playing stress range, the monofilament string formed with the method according to the present invention provides improved playing characteristics, especially enables a player starting tennis to develop a 'feeling' for the ball faster and allows him to rapidly improve his experience and quality of play. In other words, a tennis player who starts learning how to play tennis will enjoy better control over the ball than with a standard monofilament string or than with a standard monofilament string with 'islands in the sea'.

A further advantage of the monofilament string according to the present invention is that the desired characteristics of the monofilament string are obtained during production in one step. There is no need for multiple treatment steps that are required for example during production of multifilament strings. The manufacturing method according to the present invention is drastically simplified and the time is drastically shortened with a better control of the process parameters, which reflects amongst others in a more consistent material, lower costs, less energy and material use, and also a decrease of the environmental impact and decreased emission of gasses which contribute to global warming.

If necessary, the alkylbenzyl ester is added in advance to at least one molten polymer or polymer mixture for the creation of a homogeneous thermoplastic mixture in order to subsequently be extruded alone or together with other polymers or polymer mixtures in accordance with a desired pattern, by making use of two or more extruders and an especially designed spinning plates package. Generally speaking at least one extruder is used for the island components and at least one extruder is used for the sea component. Hereby the first plastic compound is extruded by a first series of openings in a mold and the second plastic compound is simultaneously extruded by a second series of openings in a mold at heightened temperature such that a bonding of the first and second plastic compound is obtained. Various polymers or polymer mixtures can have a different melting point and it should be observed that the processing temperature is selected in such a way that at the melting point of the first polymer no degradation of the other polymers takes place. After extrusion the obtained thread is the monofilament string matrix which is first dried on the air and subsequently sent through a water bed for further cooling down. Subsequently the monofilament string matrix is stretched in order to obtain a monofilament string with the desired diameter of 0.1 mm to 2 mm, preferably 0.6 to 1.4 mm. To this means the monofilament string matrix is subsequently guided over various rolls, at increased temperature, temperature via ovens, infrared, microwaves, steam, hot water, et al. Furthermore, the next roll constantly has a higher cycle time than the previous roll, with the exception of the last roll that has a lower cycle time, in order to provide the material of the monofilament string matrix with shrinking characteristics. Subsequently the monofilament string is wound on a roll. The cycle time of the third roll can for instance be 4 to 12 times higher than the cycle time of the first roll. However, one is capable to adjust the desired proportions, taking the intended stretching degree of the monofilament string matrix into account. The cycle time of the rolls can be varied within broad limits, for example of 5 m/min for the first roll to 200 m/min for a third and/or fourth roll. Therefore, the created monofilament string can if necessary finally still be subjected to a surface treatment, for example to a plasma treatment, for improvement or adjustment of the surface characteristics, for example of the capacity to be printed upon.

According to an optional aspect of the invention, the method further comprises the step of dispersing a siloxane polymer in the thermoplastic plastic of the island regions, thereby doping the thermoplastic plastic.

This way, using a siloxane polymer imparts processing improvements and modified surface characteristics. The siloxane polymer further improves throughput of the method, reduces energy consumption of the method, enhances scratch resistance of the produced monofilament strings, improves the slip properties of the monofilament string and enhances the stability of the manufacturing process versus traditional processing aids and lubricants. When added to HYTREL or similar polyester elastomers at 0.2% to 2%, improved processing and flow of the resin is expected, including better mold filling, less extruder torque, internal lubrication mold release and faster throughput. At higher addition levels, 2% to 10%, improved surface properties are expected, including lubricity, slip, lower coefficient friction and greater mar and abrasion resistance. Preferably, 2 to 10% of siloxane polymer is added to one or more of the island regions of a monofilament string to dope the island regions. Even more preferably, 2 to 8% of siloxane polymer is added to one or more of the island regions of a monofilament string to dope the island regions According to an optional aspect of the invention, the step of embedding a plurality of island regions comprising a thermoplastic plastic doped with one or more doping agents in the sea region corresponds to forming island regions in the sea region wherein the island regions comprise a cross-section with a substantially circular shape and with at least one contact side leaning close against at least one contact side of another island region and with one surface side leaning close against a surface of the covering material of the monofilament string matrix such the surface side displays a curvature which lines the curvature of the surface of the covering material of the monofilament string matrix.

According to a third aspect of the invention, there is provided the use of a siloxane polymer in a monofilament string for use in string racket sports, wherein monofilament string comprises:

a covering material;

a core material embedded in the covering material, wherein the core material comprises:

a sea region comprising a thermoplastic elastomer; and a plurality of island regions comprising a thermoplastic plastic doped with one or more doping agents, wherein the plurality of island regions is embedded in the sea region;

and wherein said one or more doping agents comprise a siloxane polymer dispersed in the thermoplastic plastic to increase the stability of the monofilament string.

DETAILED DESCRIPTION OF EMBODIMENT(S)

Figure 1:
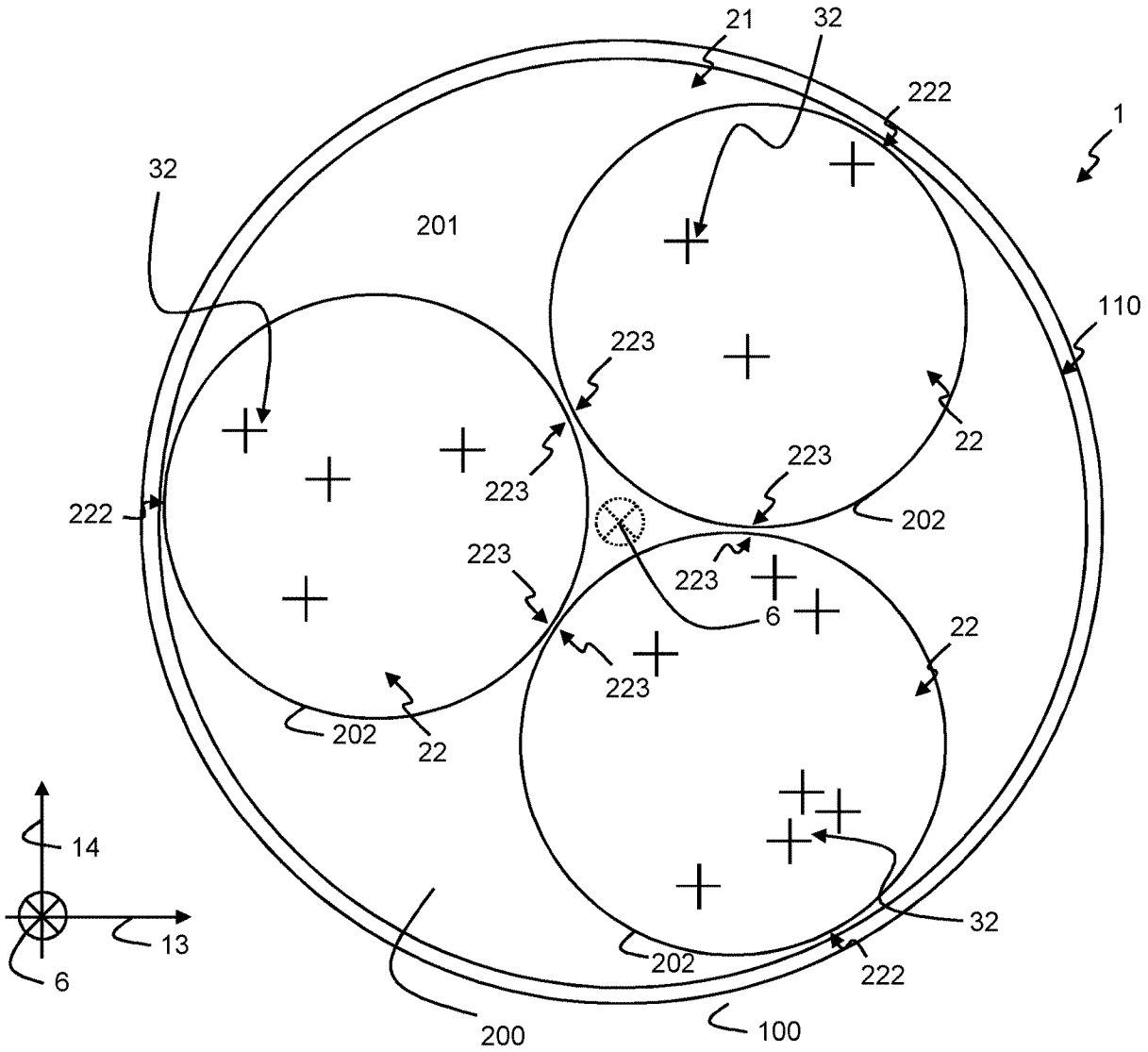
FIG. 1 schematically illustrates an embodiment of a monofilament string according to the present invention.

According to an embodiment shown in FIG. 1, a cross-section of a monofilament string 1 along a longitudinal axis 6 is schematically depicted. A monofilament string 1 comprises a covering material 100 and a core material 200 embedded in the covering material 100. The core material 200 comprises a sea region 201. The sea region 201 comprises a thermoplastic elastomer 21. The core material further comprises three island regions 202 which each comprise a thermoplastic plastic 22 doped with one or more doping agents 32. The island regions 202 are embedded in the sea region 201. The island regions 202 are arranged in a geometrical pattern with respect to each other and with respect to a longitudinal axis 6 of the monofilament string 1. The longitudinal axis 6 is traverse to a first axial axis 13 of the monofilament string 1 and is also traverse to a second axial axis 14 traverse to the first axial axis 13. The geometry of the island regions 202 is such that each of the island regions 202 comprises a cross-section with a semi-circular shape and with one surface side 222 leaning close against a surface 110 of the covering material of the monofilament string 1 such the surface side 222 displays a curvature which lines the curvature of the surface 110 of the covering material of the monofilament string. The geometry and the distribution of the island regions 202 are such that each of the island regions 202 comprises a cross-section with a substantially circular shape and with at least one contact side 223 leaning close against at least one contact side 223 of another island region 202. Each of the island regions 202 further comprises two contact sides 223, wherein each contact side 223 of an island region 202 leans close against a contact side 223 of another island region 202. Preferably, the geometry of the island regions 202 is such that each of the island regions 202 comprises a cross-section with a circular shape. As visible on FIG. 1, the three island regions 202 have identical surfaces on the cross-section along the longitudinal axis 6. According to an alternative embodiment, the three island regions 202 have different surfaces on the cross-section along the longitudinal axis 6.

Figure 2:
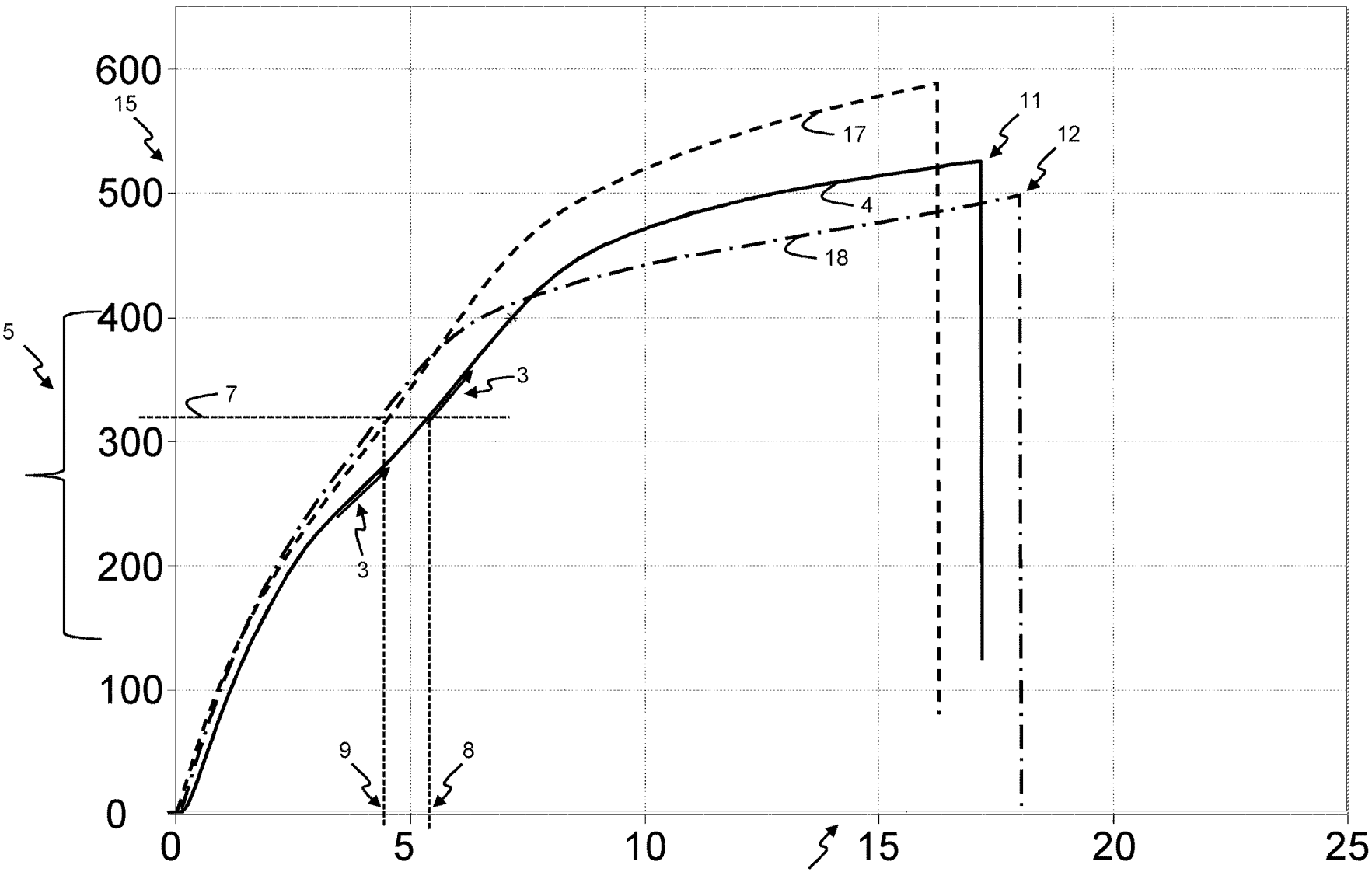
FIG. 2 schematically illustrates an embodiment of a stress-strain curve of a monofilament string according to the present invention.

According to an embodiment shown in FIG. 2, a stress 15 versus strain 16 curve 4 of a monofilament string according to the present invention is schematically depicted. The geometry and/or a distribution of the island regions 202 in the sea region 201 is such that a tangent modulus 3 of a stress-strain curve 4 of the monofilament string 1 increases with increasing strain in a playing stress range 5. The playing stress range 5 corresponds to a total force applied to the monofilament string comprised between 150 Newton and 400 Newton. The tangent modulus 3 of the stress-strain curve 4 is comprised between 2000 MPa and 5000 MPa. A soft feeling is produced when hitting a tennis ball with the monofilament string with a total force comprised between 210 Newton and 250 Newton, and a hard feeling is produced when hitting a tennis ball with the monofilament string with a total force comprised between 270 Newton and 320 Newton. The monofilament string demonstrates a larger elasticity than a standard monofilament string 17 and a larger elasticity than a standard monofilament string 18 with 'islands in the sea' in a playing stress range 5. The stress-strain curve 4 of the monofilament string demonstrates a positive curvature in the playing stress range 5, while the stress-strain curves of a prior art standard monofilament 17 and a prior art standard monofilament 18 with 'islands in the sea' both demonstrate a negative curvature or a constant tangent modulus in the same playing stress range. The geometry and/or a distribution of the island regions in the sea region of the monofilament string is such that a stress-strain curve 4 of the monofilament string comprises a positive curvature, i.e. a positive derivative of the derivative of the stress-strain curve, in a playing stress range 5. In the playing stress range 5 and at constant stress 7, a monofilament string wherein one or more doping agents comprise a siloxane polymer demonstrates a strain 8 that is 4 to 15% larger than a strain 9 demonstrated by a prior art standard monofilament string 18 wherein one or more doping agents comprise a thermoplastic elastomer. A breaking stress 11 of a monofilament string wherein one or more doping agents comprise a siloxane polymer is 10 to 15% larger than a breaking stress 12 of a monofilament string 18 wherein one or more doping agents comprise a thermoplastic elastomer.

Figure 3:
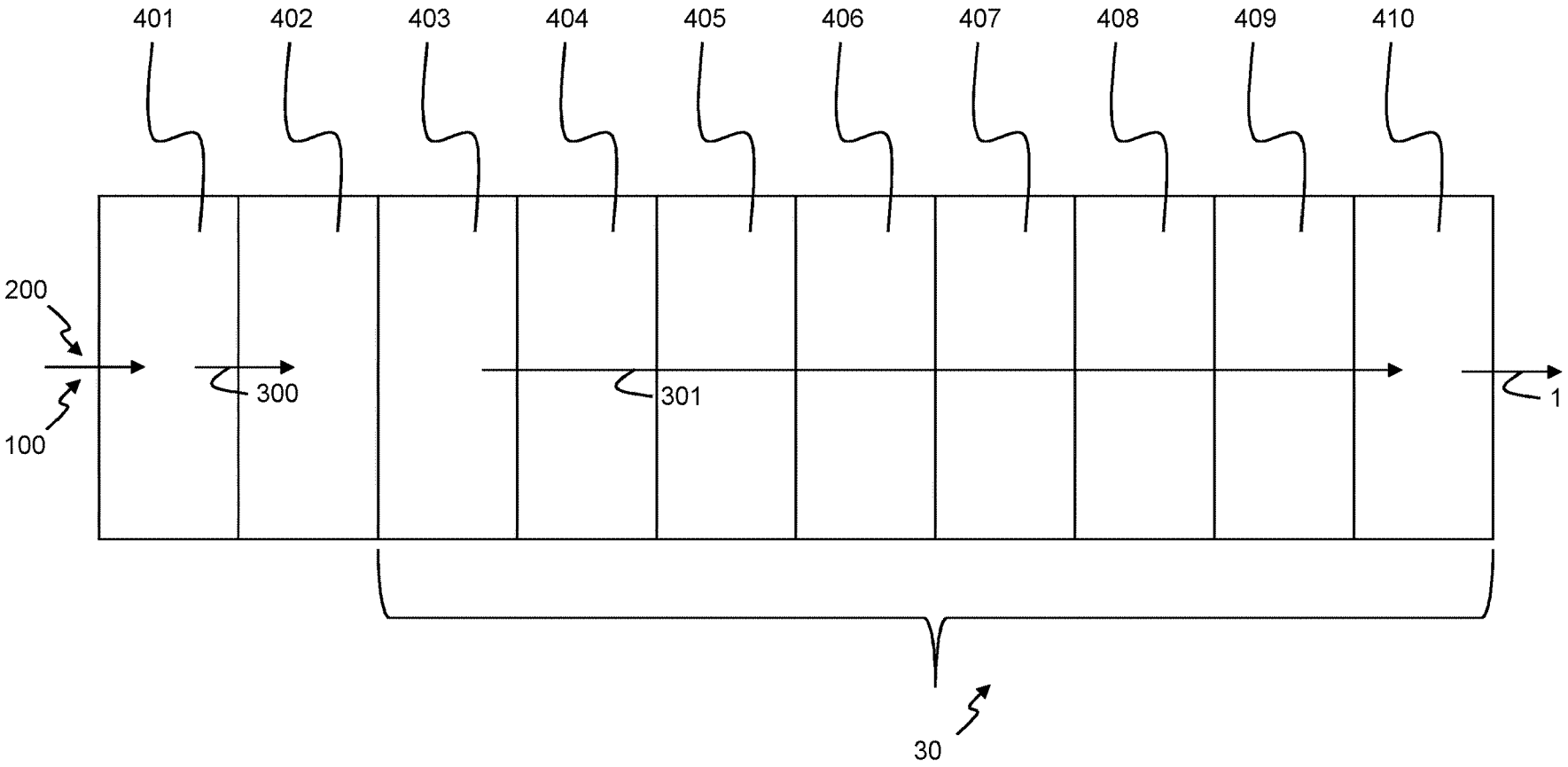
FIG. 3 schematically illustrates an embodiment of a method according to the present invention.

An embodiment of the method according to the present invention is depicted in FIG. 3. In step 401, a covering material 100 and a core material 200 are provided. The core material 200 and the covering material 100 are provided in pellets and are melted at a temperature comprised between 260 and 280° C. The core material 200 is embedded in the covering material 100 by forming a sea region comprising a thermoplastic elastomer and by embedding a plurality of island regions comprising a thermoplastic plastic doped with one or more doping agents in the sea region, thereby forming a monofilament string matrix 300. The island regions are formed by embedding a plurality of island regions comprising a thermoplastic plastic doped with one or more doping agents in the sea region corresponds to forming island regions in the sea region wherein the island regions comprise a cross-section with a substantially circular shape and with at least one contact side leaning close against at least one contact side of another island region and with one surface side leaning close against a surface of the covering material of the monofilament string matrix such the surface side displays a curvature which lines the curvature of the surface of the covering material of the monofilament string matrix 300. The monofilament string matrix 300 is extruded in step 401. Although one would expect that the thermoplastic elastomer degrades if it is heated up to a temperature that is too high, it was established that this effect in the monofilament string 1 is negligible and a string with a good strength, tensile strength, consistent characteristics and lifespan is obtained. In consecutive step 402, the monofilament string matrix 300 is quenched and cooled down to a temperature comprised between 30 and 60° C. The monofilament string matrix 300 is then subjected in consecutive steps 403 to 410 to a process cycle 30. The process cycle 30 comprises four times stretching the monofilament string matrix 300, thereby resulting in a stretched monofilament string matrix 300, and four respectively consecutive anneals of the stretched monofilament string matrix 300. The first stretching degree is comprised between 3 and 4 and the first anneal is performed at a temperature comprised between 140 and 190° C. The second stretching degree is comprised between 1.5 and 2.5 and the second anneal is performed at a temperature comprised between 180 and 230° C. The third stretching degree is comprised between 0.8 and 1.2 and the third anneal is performed at a temperature comprised between 180 and 230° C. The fourth stretching degree is comprised between 0.9 and 1.3 and the fourth anneal is performed at a temperature comprised between 100 and 150° C. After the process cycle 30, the monofilament string 1 is formed.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A monofilament string for use in string racket sports, wherein said monofilament string comprises:

a covering material;

a core material embedded in said covering material, wherein said core material comprises:

a sea region comprising a thermoplastic elastomer; and a plurality of island regions comprising a thermoplastic plastic doped with one or more doping agents, wherein said plurality of island regions is embedded in said sea region; and wherein a size shape and/or a distribution of said island regions in said sea region is such that a tangent modulus of a stress-strain curve of said monofilament string increases with increasing strain in a playing stress range.

2. The monofilament string according to claim 1, wherein said distribution of said island regions is such that said island regions are arranged in a geometrical pattern relative to each other and/or to a longitudinal axis of said monofilament string.

3. The monofilament string according to claim 1, wherein said size and shape of said island regions is such that each of said island regions comprises a cross-section with a substantially circular shape and with one surface side facing a surface of said covering material of said monofilament string such that said surface side displays a curvature which lines said curvature of said surface of said covering material of said monofilament string.

4. The monofilament string according to claim 1, wherein said size and shape and said distribution of said island regions are such that each of said island regions comprises a cross-section with a substantially circular shape and with at least one contact side facing at least one contact side of another island region.

5. The monofilament string according to claim 1, wherein said monofilament string comprises three island regions.

6. The monofilament string according to claim 5, wherein each of said island regions comprises one surface side facing a surface of said covering material of said monofilament string such that said surface side displays a curvature which lines said curvature of said surface of said covering material of said monofilament string; and wherein each of said island regions further comprises two contact sides, wherein each contact side of an island region faces a contact side of another island region.

7. The monofilament string according to claim 1, wherein said playing stress range corresponds to a total force applied to said monofilament string comprised between 150 Newton and 400 Newton.

8. The monofilament string according to claim 1, wherein said tangent modulus of said stress-strain curve is comprised between 2000 MPa and 5000 MPa.

9. The monofilament string according to claim 1, wherein a strain is produced when hitting a tennis ball with said monofilament string with a total force comprised between 210 Newton and 250 Newton that is larger than a strain produced when hitting a tennis ball with said monofilament string with a total force comprised between 270 Newton and 320 Newton.

10. The monofilament string according to claim 1, wherein said thermoplastic plastic of said island regions comprises one polymer from the group of thermoplastic polyesters and/or a copolymer and/or a block copolymer and/or a mixture of two or more of these polymers.

11. The monofilament string according to claim 1, wherein said one or more doping agents further comprise a thermoplastic elastomer dispersed in said thermoplastic plastic.

12. The monofilament string according to claim 1, wherein said one or more doping agents comprise a siloxane polymer dispersed in said thermoplastic plastic.

13. A method for manufacturing a monofilament string for use in string racket sports, said method comprising the steps of:

providing a covering material;

providing a core material;

embedding said core material in said covering material by forming a sea region comprising a thermoplastic elastomer and by embedding a plurality of island regions comprising a thermoplastic plastic doped with one or more doping agents in said sea region, thereby forming a monofilament string matrix, and wherein a size, shape and/or a distribution of said island regions in said sea region is such that a tangent modulus of a stress-strain curve of said monofilament string increases with increasing strain in a playing stress range;

extruding said monofilament string matrix;

cooling said monofilament string matrix;

subjecting said monofilament string matrix to a process cycle comprising:

stretching said monofilament string matrix, thereby resulting in a stretched monofilament string matrix;

annealing said stretched monofilament string matrix;

thereby forming said monofilament string.

* * * * *